US005466092A

United States Patent [19]

Semenza et al.

[11] Patent Number: 5,466,092

[45] Date of Patent: Nov. 14, 1995

[54] FORM-DRAIN FILTER

[76] Inventors: Christopher G. Semenza, 101 Boyack Rd.; Richard Tremblay, 6 Hiawatha Dr., both of Clifton Park, N.Y. 12065

[21] Appl. No.: 142,516

[22] Filed: Oct. 25, 1993

[51] Int. Cl.[6] ..... E02B 11/00; E02D 31/02

[52] U.S. Cl. ..... 405/45; 52/169.5; 405/50; 405/229

[58] Field of Search ..... 405/36, 43, 45, 405/50, 229; 52/169.5, 169.14

[56] References Cited

U.S. PATENT DOCUMENTS

| | | | |
|---|---|---|---|
| 3,563,038 | 2/1971 | Healy et al. | 405/45 |
| 3,946,762 | 3/1976 | Green | 138/140 |
| 4,705,048 | 11/1987 | Ahlgrimm | 405/45 |
| 4,720,209 | 1/1988 | Iams | 405/36 |
| 4,733,989 | 3/1988 | Harriett | 405/43 |
| 4,749,306 | 6/1988 | Demeny et al. | 405/45 |
| 5,107,642 | 4/1992 | Mogstad | 52/169.5 |
| 5,120,162 | 6/1992 | Parker | 405/45 X |
| 5,224,799 | 7/1993 | Parker | 405/45 X |

OTHER PUBLICATIONS

American Engineering Fabrics, Inc.; Specification sheet (catalog cut) for Geotextiles; 2 pages.

*Primary Examiner*—David H. Corbin

[57] ABSTRACT

A form-drain filter for blocking the entry of fine particulate, as silt or slurry, into the drain and/or sump system. The filter consists in a fine particulate filter fabric of mesh small enough to sieve from subterranean waters all particulate capable of clogging a drain network, including drainage sumps and associated pumps. The filter is provided with non-biodegradable, water-impervious adhesive(s) along selected margins of the fabric. Adhesive(s) is (are) of a permanent type to bind the fabric to portions of siliceous footings and/or tile or plastic conduits.

7 Claims, 1 Drawing Sheet

FORM-DRAIN FILTER

BACKGROUND OF THE INVENTION

1. Field of the Invention

The instant invention relates generally to fine particulate filtration near building foundations and, specifically, to an adhesive-bearing filter fabric adapted to fit, and permanently adhere, to a plank shaped form that is installed in a generally moist or wet environment. The plank shaped form that comprises a cofeature of this invention is disclosed in U.S. Pat. Nos. 5,120,162 and 5,224,799, hereinafter incorporated by reference.

2. Discussion of Relevant Art

The previously incorporated references, U.S. Pat. Nos. 5,120,162 and 5,224,799 relate to a permanently installed, plank shaped form-drain and accessories therefor which bear foramens on specific surfaces thereof and which, in subterranean emplacement, serve as both a concrete form and a footing/foundation drain. Neither of these patents disclose, nor deal with, apparatus that would prevent the passage of fine particulate, as slurry or silt, into the drainage network that is realized by the normal installation of the patented form-drain. Recognition of the requirement for sump pumps reasonably highlights the need for filtration before the particulate-laden drainage enters the drain system and gravity-flows to the sump(s).

Art dealing with drain-contacting filtration apparatus includes U.S. Pat. Nos. 4,720,209, 3,946,762 and 4,704,048. The first, '209, discloses a filter-covered foraminous (perforate, slotted, or multi-holed) drain pipe that is used to drain a drywell structure. The fabric material is applied over the pipe as a rectangular wrap that is secured about the pipe by joining it to its margins by an undisclosed "suitable" adhesive. The second patent, '762, discloses a filter fabric formed into a sleeve by joining opposing longitudinal margins using stitching, to form a seam. The sleeve is then drawn over all the foraminous tubular pipes of a drainage system. Finally, the third patent, '048, teaches a plank-like, insulator-drain having a filter fabric secured thereto. The insulator-drain is applied on the exterior basement walls of a structure and is essentially solid rather than hollow. Vertical grooves in the isulative plank are designed to accept tubular retainers that secure the fabric in the grooves and to the plank surface.

The aforementioned filtration apparatus patents, having significant deficiencies, cannot satisfy our requirements for providing fine particulate and silt exclusion from the herein identified form-drain apparatus. Because of the conventional gravel and fill requirements demanded of the form-drain installation, adhesion of the filter fabric to the from-drain is mandatory. Further, the adhesion must be permanent, so fixation of the fabric to the plastic of the form drain must be made in contemplation of dissimilarity in materials, i.e., plastic, siliceous, etc. The apparatus and methodology of '209 is found wanting because first, there is no ground or fill surround that can conceivably move the fabric from its emplacement, regardless of freeze-thaw or earth movement conditions. Such is not the case with the '162 form-drain. Second, the fabric of '209 is further secured by a clamping ring that serves to immobilize the pipe; thus, it has no need for rigorous adhesive treatment. Finally, the securing of the fabric to itself begs the question of "suitability" of adhesive since, like seaming of the seeve of '762, the margins may be stitched and yet function as the patentee devised.

Turning to the sleeve of '762, we determined that, although the sleeve fabric will exclude some measure of coarse particulate, such is more likely enhanced by the fact that the patented apparatus is an irrigation system and water flows out of the conduits rather than into them. Thus, the fabrics disclosed do not face the conditions of particulate and slurry contamination to which our invention is exposed. A greater deficiency of the '762 sleeve is the fact that were it to be adapted to the form-drain apparatus disclosed as in 1. Field of the Invention, the requisite fabric (relative to thickness, strength and mesh) would be unwieldy and excessive. From a consideration of labor and cost factors alone, use of the '762 filtration is not advisable.

Lastly, filter fabric adherence, as taught in '048, would be contraindicated with the form-drain. The latter is devised with minimum surface distortion (save the foramens of a single side) and the grooving of the former teaches contrary to the use of adhesives.

Thus, we invented a filter device that would successfully exclude fine particulates from the fluids flowing into the instant form-drain. This was accomplished by adapting suitable filter fabrics to fit onto the form-drain after it has been installed in the field. To secure the fabic properly, it has been provided a (longitudinal) margin adhesive that is covered by a removable, nontacky paper or plastic strip. To better understand the types of materials used, we refer the reader to the hereinafter disclosed products and current practices.

Products and Current Practices

Filter Fabrics—Textiles are used extensively in wall coverings, roofing materials and filter fabrics. Highly versitle types are being used which suit our purposes for this invention. Primarily, we selected the American Engineering Fabrics, Inc. line of nonwoven geotextiles, those used in contact with soil. Consisting of 100% staple polyester and polypropylene needle-punched fabrics, they are used in multi-purpose ground emplacements. Such emplacements demand resistance to tears, soil chemicals, puncture, ultraviolet light exposure and, most importantly, insensitivity to hydrocarbons, mildew, rot and freeze-thaw conditions.

Additionally, woven filter fabrics, although not as suitable for our purposes as the above geotextiles, can also be used. Such fabrics, as are made of Dacron (™) or Acrilan (™), are suitable and were employed in the sleeve or sheath filter of U.S. Pat. No. 3,946,762 (ibid.).

Adhesives—Several polymeric adhesives a available for permanently fixing one substance to another. For ease in manufacturing/assembly, we selected a two-sided NYLON (™) brand plastic adhesive tape. The specific product is trademarked MANCO (™) and is made available by Manco, Inc. of Westlake, Ohio. The MANCO (™) tape is provided with an adhesive that will adhere to cement or siliceous materials, as well as most construction plastics such as PVC (polyvinylchloride).

Installation Practices—Filters provided with most structure drains are not emplaced or secured with adhesives. The sleeve or sheath type filter is merely drawn over the tiles or pipes used in a drainage network. [ Note: In an irrigation system, the ends of the fabric may be glued or adhesive-fixed to the piping only to preclude a slurry backflow after the pressure-fed irrigation waters are turned off. This also precludes significant movement that might be caused by forceful irrigation waters.]

Most drain installations are emplaced and then covered with filter fabrics which are "tucked" about the drain tiles and held in place by sand or gravel back-fill. If not properly installed, soil or gravel movement, even the process of back-filling, may create crevices, tears or separations in the fabric integrity which provides entry points for soil particulates as silt or slurry. This particular installation is very labor intensive and is a distinct disadvantage that is overcome by our new form-drain filter method and appartus.

SUMMARY OF THE INVENTION

We have overcome the deficiencies and disadvantages of the prior art and current practices in providing a filter apparatus for the newly patented form-drain. To achieve this we have selected the most versitle filter fabric and provided it with an adhesive strip to adapt it for fixture to the form-drain having a rectangular cross section. It is sized to be more cost-effective than sleeving, yet designed to be fixed to the form-drain in several modes to accomodate specific installation requirements or the particular desires of installation personnel.

A retangular bolt of fabric is provided a longitudinally marginal strip, fillet or ribbon of adhesive. The adhesive is impervious to water and dilute hydrocarbons and is applied to the fabric at the time of sizing or soon afterwards, during initial manufacture. During such manufacture, the side of adhesive which will contact drain surfaces (be they siliceous, terra cotta, bitumenous or plastic) is given a coating or covering of suitable (paper,plastic) protective material to protect its tack or stickiness against contamination. Alternatively, the fabric side opposite the adhesive margin may be coated with anti-adhesion material such as one of several polymeric, quick-curing compounds that are available on the market. Then, as the fabric is rolled for packaging, the tacky adhesive portions are superposed the nontacky, anti-adhesion portion on the reverse side of the same margin; thus, the adhesive margin remains covered and protected until the fabric is unrolled for usage.

A second cost-effective embodiment of adhesive application contemplates use of double-sided adhesive tape. This tape is provided to the industry on rolls, and having one side already covered with a removable protective strip. As the tape is unrolled, one adhesive side is uncovered and is placed marginally onto the fabric. Thus, the invention is formed and a user has but to remove the protective covering strip from the adhesive-bearing margin and apply the fabric to the form drain as hereinafter shown. It is apparent that the tape may be applied, as above, during rolling of the fabric for packaging, or at the site of drain installation. The latter process is, however, tedious and labor-intensive; and, it appears to mimic the disadvantageous procedures presently in use. We therefore prefer complete fabrication of the invention at manufacture's facilities.

DETAILED DESCRIPTION OF THE PREFERRED EMBODIMENT

We have devised the instant invention for installation at the site of form-drain emplacement. Because the foraminous elements are often cut during the form-building process, it is not advisable to equip each with a filter "drape" or partial shroud at the factory. Also, not every use of the form-drain demands some form of filtration; therefore, post form-drain installation filter application is much more economical. Coupled with fabric draping or partial shrouding, rather than sleeving, this piecewise filter application realizes significant cost savings for the builder. Finally, true versatility in time and function is realized in that the adhesives of this invention can adhere to concrete, thus allowing the filter installer to place the adhesive margin virtually anywhere along the form-drain or on (and along) the footing or wall base, if already constructed.

Figure 1:
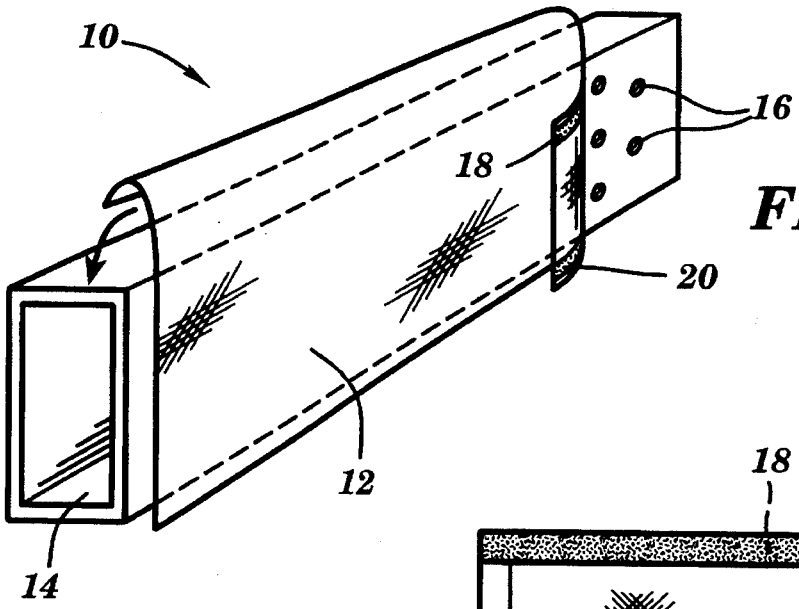
FIG. 1 is a perspective illustration of the instant invention cofeaturing a form-drain element and an adhesive-backed filter sheet.
Figure 2:
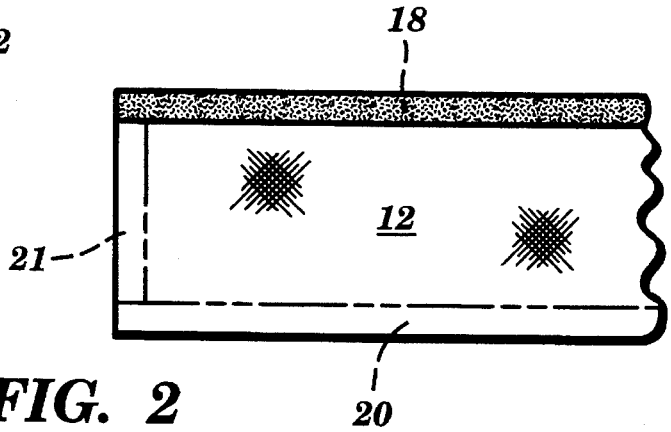
FIG. 2 is an illustration of the adhesive side (back) of the filter sheet of FIG. 1.

Refering particulary now to FIG. 1, the nominal emplacement of the invention 10 is shown. A strip of the filter fabric 12 is shown poised for attachment to an element 14 of the form-drain. Placement of the adhesive margin 18 onto the element, as shown by the dashed line (with arrowhead), will allow drapage of the fabric over the foramens 16 of the element. Optional adhesive margin 20 is depicted as the lower longitudinal margin artifact. FIG. 2 illustrates a portion of the reverse side or back of the filter fabric 12. Along the top (longitudinal) margin is placed the multifunctional adhesive 18 that adheres to most construction materials, including concrete and plastics. Along the bottom margin is the optional adhesive 20 which is preferably of a type that will adhere not only to the spectrum of materials adhered by the multi-functional adhesive 18, but to the selectively anti-adhesive fillet (see FIGS. 3–5) that backs the multi-functional adhesive margin. This facility allows the filter 12 to be wrapped around tubular tiles and afixed thereto in abuttment (top to bottom margin) or overlapped (bottom margin 20 onto top margin anti-adhesive fillet 18'). Either of the adhesive margins will, however, adhere to the filter fabric 12. Thus, we feel that when employing the bottom margin adhesive, either an anti-adhesive covering should be placed on its backside or, since it usage will most often not be required, adhesive margin 20 need only be applied in the field using double-sided adhesive tape.

Figure 3:
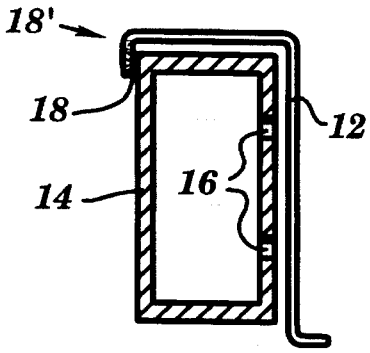
FIG. 3 is a cross-sectional elevation of the form-drain filter apparatus in one mode of installation.
Figure 4:
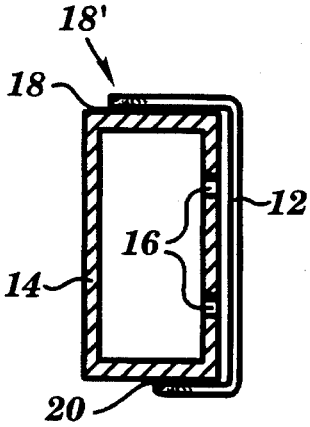
FIG. 4 and FIG. 5 depict the FIG. 3 apparatus in alternate modes of installation.
Figure 5:
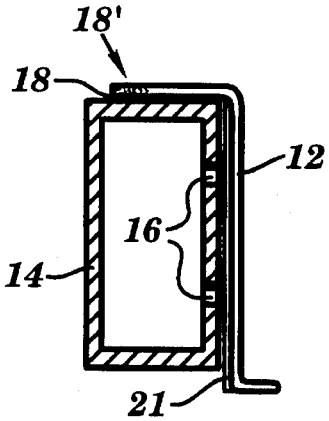

FIG.3 through FIG.5 are cross-sectional elevations of a form-drain used in this combinational invention. All show the various drapings of filter fabric 12 onto the form-drain element 14. The top marginal adhesive 18 is contacted to the form-drain on the concrete, upper edge in FIG. 3, on the top surface in FIG. 4 and, again, in FIG. 5. In FIG. 3 and FIG. 5, the fabric 12 is draped over foramens 16, contacted with the ground at the base of the form-drain and folded away from the form. These filter installations may be accomplished after concrete pouring provided that margin 18 is placed in FIG. 4 and FIG. 5 positions or merely fixed on the foraminous face above the top row of foramens 16. The FIG. 4 attachment, particulary at bottom margin 20, would have to be accomplished before installation of the form-drain 14 or alternate provisions would have to be made such as: use of a narrower fabric 12; or addition, in the field, of the tape-on alternative suggested above. In most circumstances, bottom margins 20 and laterals 21 (see FIG. 2 and FIG.5) will be required or used only in special circumstances, such as excessive ground water situations and usually fine soil or sand conditions. These alternate embodiments are provided because the invention will be installed in a manner that will allow backfills with the excavated soils of the footing/ foundations and/or subterranean structures. By avoiding backfill with costly and labor-intensive gravel operations, the cost of the instant invention is easily amortized. Further, good filtration will ensure cleanliness of drain lines and associated sumps and sewers of the herein incorporated form-drain structures.

Many variations may be made using the features, elements and methods of our invention. Skilled builders may find it advantageous to apply the filter fabric to form-drain elements, irrigation pipes, drain tiles and the like in and after various fashions. Provision of the invention is a noteworthy and profitable contribution to the art and its usage is encouraged in spirit with this disclosure and consistent with the hereinafter appended claims.

What is claimed is:

1. An improved drain and filter combination for providing footing drainage in fine soils or sand, said combination comprising:

at least one foraminous footing form-drain element that is part of a footing/foundation system and is emplaced conterminous with and in permanent contact with a footing; and at least one strip of nonforaminous, porous filter fabric, said fabric having at a first face thereof at least one first longitudinal margin bearing thereon a water-impervious, non-biogradable adhesive fillet, said first longitudinal margin fixed by said adhesive fillet longitudinally along a portion of said element so that a principal portion of said fabric effects coverage of a plurality of foramens in said element.

2. The combination of claim 1 wherein said at least one strip of filter fabric further comprises on said first face a second longitudinal margin bearing thereon an adhesive fillet.

3. The combination of claim 1 wherein an anti-adhesion means is disposed as a fillet of anti-adhesive, flexible material along and comprising a backside of said first longitudinal margin.

4. A form-drain filter combination comprising at least one footing form-drain element having foramens in a surface thereof, a fine-particle, nonforaminous, porous filter fabric fixed thereto, the fabric bearing along at least one longitudinal margin thereof a concrete and plastic adhesive fillet effective for fixing said fabric on and along said element and on a footing adjacent thereto.

5. The footing form-drain filter of claim 4 further comprising said filter fabric adhesively adhered by more than one margin thereof to said element.

6. An improved method for providing a filtered footing form-drain that includes a plurality of permanently installed footing forms, one surface of the forms containing foramens that communicate with a hollow interior of the forms, the method comprising:

installing, by trenching, in a below-ground situs an integral footing form-drain complex;

attaching marginally, by nonbiodegradable, water-impervious, adhesive fillet means, strips of a fine particulate filter fabric to portions of said complex over a top surface of the complex;

drapping a principal part of said fabric over the complex, said drapping covering all foramens of said form-drain that are employed for drainage; and backfilling said situs.

7. The method of claim 6 wherein said attaching also comprises placing said adhesive fillet means on at least one longitudinal margin of the strips of said fabric; and affixing said margin to a length of said complex so as to cover all said foramens.

* * * * *